US006235154B1

(12) United States Patent
Jiang et al.

(10) Patent No.: US 6,235,154 B1
(45) Date of Patent: May 22, 2001

(54) CHLORINE DIOXIDE BLEACHING IN THE PRESENCE OF AN ALDEHYDE

(75) Inventors: Zhi-Hua Jiang, Point Claire; Barbara van Lierop, Ile Bizard; Richard McK. Berry, Ile Perrot, all of (CA)

(73) Assignee: Pulp and Paper Research Institute of Canada, Pointe Claire (CA)

( * ) Notice: Subject to any disclaimer, the term of this patent is extended or adjusted under 35 U.S.C. 154(b) by 0 days.

(21) Appl. No.: 09/266,791

(22) Filed: Mar. 12, 1999

Related U.S. Application Data

(60) Provisional application No. 60/078,042, filed on Mar. 16, 1998.

(51) Int. Cl.[7] ..... D21C 9/14

(52) U.S. Cl. ..... 162/65; 162/72; 162/87; 162/89

(58) Field of Search ..... 423/477, 478, 423/479; 162/67, 87, 88, 89, 72, 65, 74

(56) References Cited

U.S. PATENT DOCUMENTS

| | | | | |
|---|---|---|---|---|
| 4,004,967 | | 1/1977 | Brita Swan et al. . | |
| 4,406,735 | | 9/1983 | Samuelson . | |
| 5,354,435 | * | 10/1994 | Kaczur et al. | 423/278 |
| 5,474,654 | * | 12/1995 | Mendiratta et al. | 162/67 |

OTHER PUBLICATIONS

"Improving the Efficiency of Chlorine Dioxide Bleaching" by W. H. Rapson and C.B. Anderson, Transactions: Jun. 1997, pp. TR 52–55.

"Reduction of the Formation of Organically Bound Chlorine During $ClO_2$ Bleaching" by Y. Ni et al, Journal of Pulp and Paper Science: vol. 20, No. 4 Apr. 1997, pp. J103–106.

"Reduction of the Formation of AOX During Chlorine Dioxide Bleaching", by Joncourt et al, 1995 Pulping Conference, pp. 149–152, TAPPI Proceedings.

A two–step high–pH/low–pH Method for improved efficiency of D–stage Bleaching, Seger, Jul. 1992 Tappi Journal, pp. 174–180.

"The Influence of pH on the D stages of DE and ODE Bleaching Sequences", Wartiovaara, No. 10, 1982 Paperi ja Puu—pp. 581–584.

"The Influence of pH on the $D_1$ stage of a $D/CED_1$ Bleaching Sequence", Wartiovaara, No. 9, 1982 Paperi ja Puu, pp. 538–545.

1988 International Pulp Bleaching Conference, Proceedings Book 2, Poster Presentations, Jun. 1–5, 1998, Helsinki Fair Centre, Helsinki, Finland, pp. 407–412.

Investigations on the Effect of Additives During $ClO_2$ Prebleaching, Joncourt et al., 1997 ISWPC, pp. J6–1 toJ6–5.

Pulp Bleaching—Principles and Practice, Edited by C. W. Dence et al, TAPPI Press, Atlanta, Georgia, 1996, pp. 59–69, 261–290.

J. P. Casey, XP–002104563, Bleaching of Chemical Pulps, pp. 675 to 687.

* cited by examiner

*Primary Examiner*—Steve Alvo
(74) *Attorney, Agent, or Firm*—Swabey Ogilvy Renault

(57) ABSTRACT

A method which enhances the effectiveness of chlorine dioxide bleaching of lignocellulosic materials. It is effected by adding to the chlorine dioxide bleaching stage an aldehyde compound at a concentration of from about 0.01% to about 20%, by weight of the oven-dried lignocellulosic material.

25 Claims, No Drawings

CHLORINE DIOXIDE BLEACHING IN THE PRESENCE OF AN ALDEHYDE

This application claims benefit of Provisional Application No. 60/078,042 Mar. 16, 1998.

BACKGROUND OF THE INVENTION

1. Field of the Invention

This invention relates to a method for delignifying and/or bleaching a lignocellulosic material, and more particularly, to a method for improving the performance of chlorine dioxide in the process of bleaching lignocellulosic pulp.

2. Description of the Prior Art

Pulp mills are aggressively moving to elemental chlorine-free bleaching to address environmental and market issues. The move to chlorine dioxide virtually eliminates the formation of poly-chlorinated phenolic compounds, and substantially reduces the contributions of adsorbable organic halides (AOX), colour and chloroform in the effluent. Drawbacks of chlorine dioxide include the high cost of increased chlorine dioxide generation and the poorer bleaching performance of chlorine dioxide in the first stage (delignification) of the bleaching process when chlorine is replaced entirely by chlorine dioxide. The need for more oxidation equivalents increases the overall bleaching cost to reach a target kappa number and/or brightness.

Over the years various modifications and improvements to the basic chlorine dioxide process have been described in the technical literature. These efforts have addressed the optimization of the bleaching conditions and the optimization of the bleaching sequence configurations. However, little work has been done on enhancing chlorine dioxide bleaching through the use of additives. Dimethylsulfoxide, sulfamic acid and hydrogen peroxide have been tested as additives in chlorine dioxide bleaching to reduce the formation of AOX, but these additives also reduced the delignification efficiency of chlorine dioxide and increased bleaching cost to a varying degree [Y. Ni, G. J. Kubes, and A. R. P. van Heiningen, J. Pulp Paper Sci., 1994, 20(4): J103–106; M. J. Joncourt, P. Froment, D. Lachenal, and C. Chirat, International Pulping Conf., Chicago, Oct. 1–5, 1995, p 149–152; M. J. Joncourt, G. Mortha and D. Lachenal, International Symp. Wood Pulping Chemistry, Montreal, Jun. 9–12, 1997, p J6-1 to J6-5; B.-H. Yoon and L.-J. Wang, International Pulp Bleaching Conf., Helsinki, Jun. 1–5, 1998, p 407–412]. It is known that a certain proportion of chlorine dioxide is converted to chlorite during chlorine dioxide bleaching, which may represent a loss of oxidizing power of chlorine dioxide [W. H. Rapson and C. B. Anderson, CPPA Trans. Tech., Sect., 1977, 3(2):Tr52–55 and Tappi J., 1978, 61(10):97–99; I. Wartiovaara, Paperi ja Puu-Papper o. Trä, 1982, 64(9): 534–545 and 64(10): 581–584]. A two-step high-pH/low-pH method for chlorine dioxide bleaching has been proposed and tested as a means to improve the performance of the chlorine dioxide bleaching process [G. E. Seger, H. Jameel and H.-m. Chiang, Tappi J., 1992, 75(7):174–180]. The working hypothesis of the two-step method is that chlorate formation can be reduced at the higher pH conditions, and the chlorite formed in the first high-pH step can become reactive in the second low-pH step [G. E. Seger, H. Jameel and H.-m. Chiang, Tappi J., 1992, 75(7):174–180; B.-H. Yoon and L.-J. Wang, International Pulp Bleaching Conf., Helsinki, Jun. 1–5, 1998, p 407–412]. Iron has been tested as an additive in chlorine dioxide bleaching to regenerate chlorine dioxide from chlorite [M. J. Joncourt, G. Mortha and D. Lachenal, International Symp. Wood Pulping Chemistry, Montreal, Jun. 9–12, 1997, p J6-1 to J6-5]. It was found, however, that iron also reacted with chlorine dioxide and reduced its delignification efficiency. Moreover, a significant loss of pulp viscosity was observed.

SUMMARY OF THE INVENTION

It is one object of the present invention to provide an improved chlorine dioxide bleaching process.

In a typical implementation of the present invention this object is accomplished by enhancing the effectiveness of chlorine dioxide in reaction with lignocellulosic material by carrying out the reaction in the presence of an aldehyde in the delignification and/or the bleaching stages of the bleaching process. In accordance with the method of the present invention the lignocellulosic pulp after reaction with chlorine dioxide in the presence of the aldehyde may be bleached in accordance with known bleaching and extraction methods.

Thus, in accordance with the invention, the chlorine dioxide delignification and/or bleaching performance is improved, compared to the performance obtained with conventional chlorine dioxide bleaching, as evidenced by a decrease in Kappa number, which is an indicator of the lignin content in pulp, an increase in brightness or both. Alternatively, one can practice the present invention by reducing the consumption of the chlorine dioxide required to reach a target kappa number and/or brightness.

Another object of the invention is to simplify conventional bleaching processes by using fewer bleaching stages. It has been found that a 3-stage $D_0EoD_1$ bleaching sequence with the first $D_0$ stage carried out according to the present invention can replace a 5-stage $D_0EoD_1ED_2$ sequence.

Thus in accordance with the invention there is provided, a process for improving delignification and/or brightening during the bleaching of a lignocellulosic pulp comprising reacting the lignocellulosic pulp with chlorine dioxide in the presence of an aldehyde.

In another aspect of the invention there is provided, in a process of treating a lignocellulosic pulp with a chlorine dioxide solution to effect a reduction in Kappa number and an increase in brightness of the pulp, the improvement wherein the pulp is reacted with the chlorine dioxide solution in the presence of an aldehyde.

DETAILED DESCRIPTION OF THE INVENTION

A "chlorine dioxide stage" as contemplated by the present invention can be any of the stages in a bleaching process which use chlorine dioxide. At the beginning of the sequence, the chlorine dioxide stage is typically referred to as a delignification stage, whereas in the middle or towards the end of the sequence, it is referred to as a bleaching stage.

The lignocellulosic pulps used in the method of the present invention can be derived from wood and/or non-wood derived lignocellulosic material and. This material can be treated with other known delignification, extraction, or bleaching agents before being reacted with chlorine dioxide. For example, typical stages applied to a pulp before a chlorine dioxide stage can be another chlorine dioxide stage, an alkali extraction, oxygen delignification, ozone, peroxide, peracetic acid, chelation, acid hydrolysis, enzyme treatment, applied as a single stage or as multi-stages, with or without washing between the stages.

The chlorine dioxide solution used in the method of the present invention can be generated using known processes and may or may not contain chlorine or other chlorine species. The chlorine dioxide may be added to a stage where other delignification/bleaching agents such as chlorine or ozone are being added.

In a particular embodiment: in the chlorine dioxide stage, the lignocellulosic material is placed in a vessel or container, to which is added a solution containing chlorine dioxide and a solution containing an aldehyde compound.

The aldehyde suitably is of formula:

$$RCHO, \text{ where } R=C_nH_mO_xS_yN_z$$

where n and x are each integers of from 0 to 12; m is an integer of from 1 to 24; and y and z are each integers of from 0 to 4.

In especially preferred embodiments R is H or lower alkyl of 1 to 5 carbon atoms.

This group of aldehydes includes formaldehyde, acetaldehyde, propionaldehyde, butyraldehyde, isobutyraldehyde and benzaldehyde and such aldoses as glyoxal, arabinose, xylose, mannose, rhamnose, glucose, lactose, maltose and derivatives thereof which provide a source of the aldehyde or aldose, such derivatives may be added as such or formed in situ, for example, formaldehyde bisulfite.

The reaction with chlorine dioxide is suitably conducted at a temperature within the range from about 20° C. to about 100° C. (or if pressurized, from 20° C. to about 130° C.), at a consistency from 1 to 35%, and at a pH from about 1 to about 12 for a period of from about 1 minute to about 360 minutes.

The amount of chlorine dioxide added for the bleaching process expressed as active chlorine multiple (ACM), suitably is from 0.05 to 0.5. The ACM is defined as the amount of chlorine dioxide being added to pulp, expressed as percent active chlorine on oven-dry pulp basis, divided by the Kappa number of the pulp entering the stage. The amount of chlorine dioxide added to the bleaching stage, expressed as percent on wt. of pulp oven-dry basis, can range from 0.05 to 10%.

The % consistency refers to the weight % of pulp solids in a pulp suspension.

In a preferred embodiment of the invention, the conditions in the chlorine dioxide stage containing the aldehyde are a temperature of 50° C., a consistency of 3.5%, a retention time of 30 minutes and an ACM of 0.25. In another embodiment of the invention, the conditions in the chlorine dioxide stage are a temperature of 70° C., a consistency of 10%, a retention time of 180 minutes, a chlorine dioxide charge of 1.0% in a first chlorine dioxide bleaching stage, and 0.3% in the second chlorine dioxide bleaching stage.

The aldehyde can be added as a part of the chlorine dioxide solution, as a part of the filtrates used as make-up liquor in the bleaching process, or in a separate addition. It can also be added as part of the pulp carryover from a previous stage. Benefit can also arise from adding the aldehyde after a first initial reaction of the chlorine dioxide with the lignocellulosic material.

The amount of the aldehyde compound added to the chlorine dioxide stage can be from about 0.01% to about 20%, by wt., based on the oven-dried wt. of the lignocellulosic pulp employed. It is preferred however, to employ from about 0.02% to about 5% based on the oven-dried wt. of the lignocellulosic pulp. The preferred aldehyde is formaldehyde and lower alkyl aldehydes having from 1 to 5 carbons atoms in the alkyl moiety, which may or may not contain sulphur and nitrogen.

The lignocellulosic pulps after bleaching with chlorine dioxide in accordance with the method of the present invention may then be bleached in accordance with any of the known bleaching methods including any of the known alkaline extraction methods.

In order to disclose more clearly some of the nature of the aforementioned embodiments of the present invention, the following examples are presented.

EXAMPLES

Example 1

An unbleached hardwood kraft pulp with a kappa number of 12.0 was bleached using a $D_0E$ sequence where $D_0$ represents a chlorine dioxide bleaching stage and E represents an alkaline extraction stage. Different amounts of formaldehyde were added to the $D_0$ stage.

The chlorine dioxide stage was carried out by placing the pulp in a vessel, and mixing appropriately heated water into the pulp and adjusting the pH to 3.0 using sulphuric acid. A formaldehyde solution was rapidly mixed into the pulp slurry, followed immediately by a rapid addition of the chlorine dioxide solution. The container was then closed, and mixed vigorously to disperse the solution thoroughly. The charge of chlorine dioxide added to the pulp slurry was set at 1.14% based on weight of oven-dry pulp, which is equivalent to an active chlorine multiple (ACM) of 0.25. The active chlorine multiple is defined as the amount of chlorine dioxide being added to pulp, expressed as active chlorine divided by the Kappa number of the pulp entering the stage. The charge of formaldehyde added to the chlorine dioxide stage ranged from 0 to 0.6% based on weight of oven-dry pulp. The pulp consistency was 3.5%, the reaction temperature was 50° C., and the reaction time was 30 minutes. After the reaction, the pulp was thoroughly washed with water to remove the reaction by-products.

The extraction (E) stage was carried out as a pulp slurry having a 10% consistency, a temperature of 70° C., and a reaction time of 60 minutes. The charge of NaOH was 1.0% based on the wt. of oven-dried pulp. After the extraction the pulp was, once again, thoroughly washed.

It is readily evident from an examination of the results in Table I, that the Kappa number of the washed pulp after the $D_0$ stage and the E stage was lower when formaldehyde was used, showing that the performance of the chlorine dioxide stage was increased.

TABLE 1

| Experiment number ($D_0E$ sequence) | 1 | 2 | 3 | 4 |
|---|---|---|---|---|
| Chlorine dioxide added in $D_0$ | | | | |
| as active chlorine multiple (ACM) | 0.25 | 0.25 | 0.25 | 0.25 |
| % on wt. of o.d. pulp | 1.14 | 1.14 | 1.14 | 1.14 |
| Formaldehyde added in $D_0$ | | | | |
| % on wt. of o.d. pulp | 0 | 0.04 | 0.1 | 0.6 |
| Kappa number after $D_0$ | 5.6 | 5.3 | 5.0 | 4.7 |
| Kappa number after $D_0E$ | 4.5 | 4.2 | 3.9 | 3.5 |

Example 2

An unbleached hardwood kraft pulp with a kappa number of 12.0 was bleached using a $D_0EoD_1ED_2$ bleaching sequence. Eo represents an alkaline extraction stage fortified with oxygen. The $D_0$ stage was carried out with and without formaldehyde.

The first chlorine dioxide stage ($D_0$) was carried out using the procedure employed in Example 1, with an active chlorine multiple (ACM) of 0.30 which represents a charge of 1.37% $ClO_2$ based on wt. of oven-dry pulp. The second ($D_1$) and third ($D_2$) chlorine dioxide stages were carried out using the same procedure as described for the $D_0$ stage, except that the pH was not adjusted and formaldehyde was not employed. The reaction conditions for the $D_1$ stage were: consistency 10%, reaction temperature 70° C., and reaction time 150 minutes. The charges of chlorine dioxide and NaOH in $D_1$ were 0.8 and 0.4% respectively, based on wt. of oven-dried pulp. The reaction conditions for the $D_2$ stage were consistency 10%, reaction temperature 70° C., and reaction time 180 minutes. The charge of chlorine dioxide in the $D_2$ stage was 0.15% based on wt. of oven-dried pulp.

The extraction stage fortified with oxygen (Eo) was carried out at 10% consistency in a laboratory pressurized peg mixer maintained at 0.14 MPa oxygen pressure for the first 10 minutes of the reaction, and at atmospheric pressure for 50 minutes. The reaction temperature was maintained at 70° C. The conventional extraction stage (E) was carried out using the procedure employed in Example 1, except that the charge of NaOH was 0.5% based on wt. of oven-dried pulp.

The bleaching results are shown in Table II. Compared to conventional chlorine dioxide bleaching the present invention using formaldehyde in the $D_0$ stage provides a lower kappa number after $D_0Eo$ and a higher final brightness after $D_0EoD_1ED_2$.

TABLE II

| Experiment number ($D_0EoD_1ED_2$ sequence) | 1 | 2 |
|---|---|---|
| Chlorine dioxide added in $D_0$' | | |
| as active chlorine multiple (ACM) | 0.30 | 0.30 |
| % on wt. of o.d. pulp | 1.37 | 1.37 |
| Formaldehyde added in $D_0$' | | |
| % on wt. of o.d. pulp | 0 | 0.6 |
| Kappa number after $D_0Eo$ | 4.1 | 2.6 |
| ISO brightness after $D_0EoD_1ED_2$, % | 88.1 | 89.1 |
| b* value after $D_0EoD_1ED_2$ | 4.1 | 3.8 |

Example 3

An unbleached softwood kraft pulp with a kappa number of 31.3 was bleached using a $D_0EoD_1ED_2$ bleaching sequence. The $D_0$ stage was carried out with and without formaldehyde.

The chlorine dioxide charges in the $D_0EoD_1ED_2$ sequence were as follows: 3.57% in the $D_0$ stage (0.30 ACM); 0.8%, 1.3% and 1.8% in the $D_1$ stage; and 0.3% in the $D_2$ stage. The charges of NaOH were as follows: 3.3% in the Eo stage; from 0.3 to 0.94% in the $D_1$ stage, and 0.5% in the E stage. All chemical charges are expressed as percent on pulp, oven-dry basis.

The bleaching results are shown in Table III. Compared to conventional chlorine dioxide bleaching, the present invention using formaldehyde in the $D_0$ stage provides a lower kappa number after $D_0Eo$ and a higher final brightness after $D_0EoD_1ED_2$. Surprisingly, it also allows a 3-stage sequence to achieve the same brightness as a 5-stage sequence.

TABLE III

| Experiment Number ($D_0EoD_1ED_2$ sequence) | 1 | | | 2 | | |
|---|---|---|---|---|---|---|
| Chlorine dioxide added in $D_0$' | | | | | | |
| as active chlorine multiple (ACM) | | 0.30 | | | 0.30 | |
| % on wt. of o.d. pulp basis | | 3.57 | | | 3.57 | |
| Formaldehyde added in $D_0$' | | | | | | |
| % on wt. of o.d. pulp basis | | 0 | | | 2.6 | |
| Kappa number after $D_0Eo$ | | 3.3 | | | 2.4 | |
| Chlorine dioxide charge in $D_1$' | | | | | | |
| % on wt. of o.d. pulp basis | 0.8 | 1.3 | 1.8 | 0.8 | 1.3 | 1.8 |
| ISO brightness after $D_0EoD_1$' % | 87.5 | 89.0 | 89.5 | 88.8 | 90.2 | 90.6 |
| Chlorine dioxide charge in $D_2$' | | | | | | |
| % on wt. of o.d. pulp basis | 0.3 | 0.3 | 0.3 | 0.3 | 0.3 | 0.3 |
| ISO Brightness after $D_0EoD_1ED_2$, % | 90.5 | 91.2 | 91.5 | 91.7 | 91.8 | 92.0 |

Example 4

An oxygen-delignified softwood kraft pulp with a kappa number of 16.8 was bleached using a $D_0EoD_1ED_2$ bleaching sequence. The $D_0$ stage was carried out with and without formaldehyde.

The chlorine dioxide charges in the D stages of the $D_0EoD_1ED_2$ sequence were as follows: 1.92% in the $D_0$ stage (0.30 ACM); 0.5%,1.0%, and 1.5% in the $D_1$ stage; and 0.3% in the $D_2$ stage. The charge of NaOH was as follows: 1.9% in the Eo stage; from 0.20 to 0.65% in the $D_1$ stage; and 0.5% in the E stage. All percentages are based on the weight of oven-dried pulp.

The bleaching results are shown in Table IV. Compared to conventional chlorine dioxide bleaching, the present invention using formaldehyde in the $D_0$ stage provides a lower kappa number after $D_0Eo$ and a higher final brightness after $D_0EoD_1ED_2$.

TABLE IV

| Experiment number ($D_0EoD_1ED_2$ sequence) | 1 | | | 2 | | |
|---|---|---|---|---|---|---|
| Chlorine dioxide added in $D_0$' | | | | | | |
| as active chlorine multiple (ACM) | | 0.30 | | | 0.30 | |
| % on wt. of o.d. pulp | | 1.92 | | | 1.92 | |
| Formaldehyde added in $D_0$, | | | | | | |
| % on wt. of o.d. pulp | | 0 | | | 1.5 | |
| Kappa number after $D_0EBo$ | | 3.5 | | | 2.6 | |
| Chlorine dioxide charge in $D_1$' | | | | | | |
| % on wt. of o.d. pulp | 0.5 | 1.0 | 1.5 | 0.5 | 1.0 | 1.5 |
| ISO brightness after $D_1$, % | 83.0 | 86.6 | 87.7 | 85.0 | 88.1 | 88.8 |
| Chlorine dioxide in $D_2$' | | | | | | |
| % on wt. of o.d. pulp | 0.3 | 0.3 | 0.3 | 0.3 | 0.3 | 0.3 |
| ISO brightness after $D_0EoD_1ED_2$, % | 88.9 | 90.3 | 90.8 | 90.4 | 91.3 | 91.5 |

Example 5

An oxygen delignified softwood kraft pulp with a kappa number of 16.8 was bleached using a $D_0ED_1$ and a $D_0EpD_1$ bleaching sequence. The $D_0$ stage was carried out with and without formaldehyde.

The chlorine dioxide charges were as follows: 1.92% in the $D_0$ stage (0.30 ACM); and 1.5% in the $D_1$ stage. The charges of NaOH were as follows: 1.9% in the E stage; and 0.7% in the $D_1$ stage. All percentages are based on the wt. of oven-dried pulp. The peroxide charge in the Ep stage was 1.0%.

The bleaching results are given below in Table V. Compared to conventional chlorine dioxide bleaching, the present invention using formaldehyde in the $D_0$ stage provides a lower kappa number after $D_0E$ and $D_0Ep$ and a higher final brightness after $D_0ED_1$ and $D_0EpD_1$.

TABLE V

| Experiment number ($D_0ED_1$ or $D_0EpD_1$ sequence) | 1 | | 2 | |
|---|---|---|---|---|
| Chlorine dioxide added in $D_0$' | | | | |
| as active chlorine multiple (ACM) | 0.30 | | 0.30 | |
| % on wt. of o.d. pulp | 1.92 | | 1.92 | |
| Formaldehyde added in the $D_0$ stage, | | | | |
| % on wt. of o.d. pulp | 0 | | 1.5 | |
| Kappa number after $D_0E$ | 4.9 | — | 3.2 | — |
| Kappa number after $D_0Ep$ | — | 3.4 | — | 2.0 |
| Chlorine dioxide charge in $D_1$' | | | | |
| % on wt. of o.d. pulp | 1.5 | 1.5 | 1.5 | 1.5 |
| ISO brightness after $D_0ED_1$ or $D_0EpD_1$, % | 85.2 | 88.6 | 87.4 | 90.1 |

Example 6

An unbleached softwood kraft pulp with a kappa number of 26.4 was bleached using a $D_0Ep$ sequence where $D_0$ represents a chlorine dioxide bleaching stage and Ep represents an alkaline extraction stage fortified with hydrogen peroxide ($H_2O_2$). Either formaldehyde or glyoxal or a mixture comprising both formaldehyde and glyoxal was added to the $D_0$ stage.

The chlorine dioxide stage was carried out using the procedure employed in Example 1, with an ACM of 0.30 which represents a charge of 3.01% $ClO_2$ based on wt. of oven-dry pulp. A solution of formaldehyde or glyoxal at a charge of 1.13% based on wt. of oven-dry pulp or a mixture of formaldehyde and glyoxal at a charge of 0.56 and 0.57%, respectively, each based on wt. of oven-dry pulp was added to the pulp slurry followed by a rapid addition of the chlorine dioxide solution. The reaction conditions in the $D_0$ stage were: consistency, 3.5%, 55° C. and a reaction time of 30 minutes. After the reaction, the pulp was thoroughly washed with water to remove the reaction by-products.

The extraction (Ep) stage was carried out as a pulp slurry having a 10% consistency, a temperature of 90° C., and a reaction time of 60 minutes. The charge of NaOH was 1.8% and the charge of $H_2O_2$ was 0.3%, each based on the wt. of oven-dried pulp. After the extraction the pulp was, once again, thoroughly washed.

It is readily evident from an examination of the results in Table VI, that the Kappa number of the washed pulp after the $D_0$ stage and the Ep stage was lower when formaldehyde or glyoxal or a mixture of formaldehyde and glyoxal was used, showing that the performance of the chlorine dioxide stage was improved.

TABLE VI

| Experiment number ( $D_0Ep$ sequence) | 1 | 2 | 3 | 4 |
|---|---|---|---|---|
| Chlorine dioxide added in $D_0$' | | | | |
| as active chlorine multiple (ACM) | | | 0.30 | |
| % on wt. of o.d. pulp | | | 3.01 | |
| Formaldehyde added in $D_0$, % on wt. of o.d. pulp | 0 | 1.13 | 0 | 0.56 |
| Glyoxal added in $D_0$, % on wt. of o.d. pulp | 0 | 0 | 1.13 | 0.57 |
| Kappa number after $D_0Ep$ | 4.2 | 3.6 | 3.5 | 3.6 |

Example 7

An unbleached hardwood kraft pulp with a kappa number of 12.0 was bleached using a $D_0Eo$ sequence. The $D_0$ stage was carried out with either formaldehyde bisulphite or glucose.

The first chlorine dioxide stage ($D_0$) was carried out using the procedure employed in Example 2, with an active chlorine multiple (ACM) of 0.25 which represents a charge of 1.14% $ClO_2$ based on wt. of oven-dry pulp. Either formaldehyde bisulphite at a charge of 0.6% or glucose at a charge of 0.8%, each based on wt. of oven-dry pulp, was applied in the chlorine dioxide stage.

The extraction stage fortified with oxygen (Eo) was carried using the same procedure and conditions employed in Example 2.

It is readily evident form an examination of the results in Table VII, that, compared to conventional $D_0Eo$ bleaching, the present invention using either formaldehyde bisulphite or glucose in the $D_0$ stage results in a lower kappa number after the $D_0$ stage and the Eo stage.

TABLE VII

| Experiment number ( $D_0Eo$ sequence) | 1 | 2 | 3 |
|---|---|---|---|
| Chlorine dioxide added in $D_0$' | | | |
| as active chlorine multiple (ACM) | | 0.25 | |
| on wt. of o.d. pulp | | 1.14 | |
| Formaldehyde bisulphite added in $D_0$, | | | |
| % on wt. of o.d. pulp | 0 | 0.6 | 0 |
| Glucose added in $D_0$, % on wt. of o.d. pulp | 0 | 0 | 0.8 |
| Kappa number after $D_0$ | 5.6 | 5.1 | 5.2 |
| Kappa number after $D_0Eo$ | 4.5 | 4.0 | 3.9 |

Example 8

An unbleached softwood kraft pulp which had been delignified with oxygen to a kappa number of 16.6 was bleached in a $D_0EoD_1$ sequence. The $D_1$ stage was carried with and without glyoxal.

The chlorine dioxide charges in the $D_0EoD_1$ sequence were as follows: 1.39% (0.22 ACM) in the $D_0$ stage and 1.0% in the $D_1$ stage. The charges of NaOH were as follows: 1.46% in the Eo stage; and 0.60–0.65% in the $D_1$ stage. All chemical charges are expressed as percent on pulp, oven-dry basis. The procedures employed in the $D_0$ and the $D_1$ stages in the Eo stage are described in Example 2.

It is readily evident from an examination of the results in Table VIII, that the present invention using glyoxal in the $D_1$ stage provides a pulp with a higher final brightness.

TABLE VIII

| Experiment number ($OD_0EOD_1$ sequence) | 1 | 2 |
|---|---|---|
| Chlorine dioxide added in $D_0$' | | |
| as active chlorine multiple (ACM) | | 0.22 |
| % on wt. of o.d. pulp | | 1.39 |
| Extraction stage (Eo), | | |
| NaOH, % on wt. of o.d. pulp | | 1.46 |
| Kappa number | | 4.1 |
| Chlorine dioxide stage ($D_1$), | | |
| $ClO_2$, % on wt. of o.d. pulp | 1.0 | 1.0 |
| Glyoxal added in $D_1$, % on wt. of o.d. pulp | 0 | 0.1 |
| ISO brightness, % | 83.1 | 84.8 |

What is claimed is:

1. A process for improving delignification and brightening during the bleaching of a lignocellulosic pulp comprising reacting the lignocellulosic pulp with chlorine dioxide in the presence of an aldehyde, wherein the chlorine dioxide is reacted at an Active Chlorine Multiple of 0.05 to 0.5 and said aldehyde is present in an amount of 0.02% to 5%, by weight, based on the oven-dried weight of the pulp.

2. A process according to claim 1, wherein said aldehyde is formaldehyde.

3. A process according to claim 1, wherein said aldehyde is an aldose.

4. A process according to claim 1, wherein said aldehyde is of general formula:

RCHO in which:

R is $C_nH_mO_xS_yN_z$ wherein n is an integer of 0 to 12, x is an integer of 0 to 12, m is an integer of 1 to 24, y is an integer of 0 to 4, and z is an integer of 0 to 4.

5. A process according to claim 4, wherein R is alkyl of 1 to 5 carbon atoms.

6. A process according to claim 4, wherein the reacting is carried out at a temperature of 20° C. to 130° C., at a pulp consistency of 1 to 35%, by weight, at a pH of 1 to 12 for a period of 1 to 360 minutes.

7. A process according to claim 1, wherein said reacting is in a chlorine dioxide stage of a multi-stage bleaching process.

8. A process according to claim 7, wherein said multi-stage bleaching process has a $D_0E$ sequence, and said reacting is in the $D_0$ stage.

9. A process according to claim 7, wherein said multi-stage bleaching process has a $D_0EoD_1ED_2$ sequence and said reaction is in at least one of the $D_0$, $D_1$ and $D_2$ stages.

10. A process according to claim 9, wherein said reaction is in the $D_0$ stage.

11. In a process of treating a lignocellulosic pulp with a chlorine dioxide solution to effect a reduction in Kappa number and an increase in brightness of the pulp the improvement wherein the pulp is reacted with the chlorine dioxide solution in the presence of an aldehyde, the chlorine dioxide of said solution being present at an active chlorine multiple of from 0.05 to 0.5, and said aldehyde being present in an amount of 0.02% to 5%, by weight, based on the oven-dried weight of the pulp.

12. A process according to claim 11, wherein the aldehyde is formaldehyde.

13. A process according to claim 12, wherein the pulp is reacted with the chlorine dioxide solution in the $D_0$ stage of a $D_0EoD_1$ bleaching sequence.

14. A process according to claim 13, wherein the pulp is reacted with the chlorine dioxide solution in the $D_0$ stage of a $D_0EoD_1ED_2$ bleaching sequence.

15. A process according to claim 12, wherein the pulp is reacted with the chlorine dioxide solution in the $D_1$ stage of a $D_0EoD_1$ bleaching sequence.

16. A process according to claim 12, wherein the pulp is reacted with the chlorine dioxide solution in the $D_1$ stage of a $D_0EoD_1ED_2$ bleaching sequence.

17. A process according to claim 12, wherein the pulp is reacted with the chlorine dioxide solution in the $D_2$ stage of a $D_0EoD_1ED_2$ bleaching sequence.

18. A process according to claim 12, wherein the pulp is reacted with said chlorine dioxide together with chlorine or ozone.

19. A process for improving delignification and/or brightening during the bleaching of a lignocellulosic pulp with chlorine dioxide comprising adding a chlorine dioxide solution of the lignocellulosic pulp, reacting the pulp with the chlorine dioxide at an active chlorine multiple of 0.05 to 0.5 in the presence of an aldehyde in an amount of 0.02 to 5%, by weight, based on the oven-dried weight of the pulp, to produce a pulp of lower kappa and/or higher brightness than is achieved by the chlorine dioxide in the absence of the aldehyde.

20. A process according to claim 19, wherein said aldehyde is formaldehyde.

21. A process according to claim 19, wherein the reacting is carried out at a temperature of 20° C. to 130° C., at a pulp consistency of 1 to 35%, by weight, at a pH of 1 to 12 for a period of 1 to 360 minutes.

22. A process according to claim 19, wherein said reacting is in a chlorine dioxide stage of a multi-stage bleaching process.

23. A process according to claim 22, wherein said multi-stage bleaching process has a $D_0E$ sequence, and said reacting is in the $D_0$ stage.

24. A process according to claim 22, wherein said multi-stage bleaching process has a $D_0EoD_1ED_2$ sequence and said reaction is in at least one of the $D_0$, $D_1$ and $D_2$ stages.

25. A process according to claim 22, wherein said reaction is in the $D_0$ stage.

* * * * *